United States Patent [19]

Croset et al.

[11] Patent Number: 4,707,598

[45] Date of Patent: Nov. 17, 1987

[54] METHOD AND APPARATUS FOR MONITORING SHEETS FOR OVERLAPPING

[75] Inventors: Michel R. Croset; Martin Lane, both of Hampshire; Roy E. Winchester, W. Sussex; David R. Worsley, Hampshire, all of England

[73] Assignee: De La Rue Systems Limited, London, England

[21] Appl. No.: 749,841

[22] Filed: Jun. 28, 1985

Related U.S. Application Data

[63] Continuation-in-part of Ser. No. 625,786, Jun. 28, 1984, Pat. No. 4,650,991.

[30] Foreign Application Priority Data

Jul. 1, 1983 [GB] United Kingdom ..... 8317896
Jul. 26, 1983 [GB] United Kingdom ..... 8320149

[51] Int. Cl.[4] ..... G01N 9/04; B65H 7/12

[52] U.S. Cl. ..... 250/223 R; 271/262; 356/434

[58] Field of Search ..... 250/223 R, 559, 560, 250/561; 271/262, 263; 350/381, 383; 364/562, 563; 356/434

[56] References Cited

U.S. PATENT DOCUMENTS 3,026,419 3/1962 Aweida et al. ..... 250/223 R
4,237,378 12/1980 Jones ..... 250/223 R
4,398,711 8/1983 Horst et al. ..... 250/559

FOREIGN PATENT DOCUMENTS 0086097 8/1983 European Pat. Off. .
0132329 1/1985 European Pat. Off. .
WO81/01827 7/1981 PCT Int'l Appl. .
WO82/01698 5/1982 PCT Int'l Appl. .
2055766 3/1981 United Kingdom .
2059927 4/1981 United Kingdom .
2106081 4/1983 United Kingdom .

*Primary Examiner*—David C. Nelms
*Assistant Examiner*—S. Allen
*Attorney, Agent, or Firm*—Cushman, Darby & Cushman

[57] ABSTRACT

A method and apparatus for monitoring the passage of sheets past at least one sensing assembly (48,49). The sensing assembly (48,49) generates an output signal whose level varies in accordance with a characteristic of the sheets, for example the thickness of the sheets. The method comprises for the or each sensing assembly, presetting a first threshold (62) spaced by a predetermined amount from a datum output signal level (57) when no sheet is sensed, the predetermined amount being such that the first threshold (62) is not passed as a result of random noise variations in the output signal but is passed during the passage past the sensing means of all sheets which it is desired to monitor. The size of the output signal from the sensing means (48, 49) relative to the datum level is monitored when the output signal first passes the first threshold (62) corresponding to the passage of a first sheet. Single, double, and triple sheet thresholds (63, 64, 67) are generated from a monitored size and thereafter the output signal is monitored to sense when it passes one or more of the thresholds.

12 Claims, 5 Drawing Figures

METHOD AND APPARATUS FOR MONITORING SHEETS FOR OVERLAPPING

This application is a continuation-in-part of U.S. patent application Ser. No. 625,786, filed June 28, 1984 issued Mar. 17, 1987 as U.S. Pat. No. 4,650,991, and assigned to the assignees hereof.

BACKGROUND OF THE INVENTION

The invention relates to a method and apparatus for monitoring the passage of sheets past at least one sheet sensing assembly of a sheet feeding apparatus, the or each sensing assembly generating an output signal whose level varies in accordance with a characteristic of the sheets.

DESCRIPTION OF RELATED ART

A typical method comprises for the or each sensing assembly setting a single sheet output signal threshold at a level which will be passed by the output signal generated by the sensing assembly when a sheet passes the sensing assembly; and monitoring the output signal at least when it passes the threshold. Such methods are hereinafter referred to as of the kind described.

One example of a method of the kind described is illustrated in No. WO-A-82/01698. In this construction an expected thickness of a banknote is preset and a suitable signal is fed to an auto reference circuit which adds to the expected thickness a value representing a datum corresponding to a roller resting on a guide surface. Subsequently, when a note passes under the roller which is connected via an arm to a linear variable differential transformer, an output signal is fed to comparators which will determine whether or not a note is present. Between the passage of each note, the datum level is rechecked and a suitable correction is made by the auto reference circuit to the reference signals fed to the comparators.

One of the problems with these known methods is that where it is desired to pass, for example for counting purposes, batches of sheets having different thicknesses, ie. the sheets in each batch have substantially the same thickness but the thickness of sheets in a batch may differ from the thickness of sheets in another batch, it is necessary for an operator to reset the expected signal level which is passed when a single sheet is detected.

SUMMARY OF THE INVENTION

In accordance with one aspect of the present invention, a method of the kind described comprises presetting a first threshold spaced by a predetermined amount from a datum output signal level achieved when no sheet is sensed, the predetermined amount being such that the first threshold is not passed as a result of random noise variations in the output signal but is passed during the passage past the sensing assembly of all sheets which it is desired to monitor; monitoring the size of the output signal relative to the datum level when the output signal first passes the first threshold corresponding to the passage of a first sheet; generating the single sheet threshold from the monitored size; and thereafter sensing when the output signal passes the thresholds.

In accordance with a second aspect of the present invention, apparatus for monitoring the passage of sheets past at least one sensing assembly, the sensing assembly being adapted to generate an output signal whose level varies in accordance with a characteristic of the sheets, comprises storage means for storing for the or each sensing assembly a single sheet output signal threshold corresponding to a signal level which will be passed by the output signal generated by the sensing assembly when a sheet passes the sensing assembly; monitoring means for monitoring the output signal; means for storing a first, preset threshold spaced by a predetermined amount from a datum output signal level achieved when no sheet is sensed, the predetermined amount being such that the first threshold is not passed as a result of random noise variations in the output signal but is passed during the passage past the sensing assembly of all sheets which it is desired to monitor, the monitoring means being adapted to monitor the size of the output signal relative to the datum level when it first passes the first threshold; and calculating means for calculating the single sheet threshold from the monitored size and for storing the single sheet threshold in the storage means.

By presetting a first threshold a very significant advance is made in that it is now possible automatically to process batches of sheets with different characteristics such as thicknesses without requiring an operator manually to preset a single sheet threshold for each batch. In the invention, the first sheet of a batch fed through the sheet feeding apparatus is used to set up the single sheet threshold. A further important advantage is that by maintaining the first threshold it is possible to sense the passage of sheets in which the output signal from the sensing means does not pass the single sheet threshold. This was not possible in previous constructions where the passage of such a sheet would simply be ignored by the system leading, in the case of counting apparatus, to an erroneous count. This is important in the present system since if the first "sheet" fed is in fact an incorrect feed such as a pair of sheets overlapped then the single sheet threshold generated will be incorrect. This will be detected, however, when the next sheet is fed since the "single sheet threshold" set up will not be passed by the output signal from the sensing means. In such a situation, it is preferable if the method further comprises generating an error signal if the output signal passes the first threshold but not the single sheet threshold. This error signal can be used for example to stop the sheet feeding apparatus to enable the incorrectly fed sheets to be retrieved by an operator.

Typically, the thresholds will comprise positive values such as voltage levels which, when sheets pass the sensing means, are exceeded by the output signal.

Typically, in a batch of sheets each of which has the same characteristic, there may be some minor variations in the characteristic. Preferably, therefore, the single sheet threshold is generated as a proportion of the output signal generated by the sensing means when a sheet passes the sensing means. In one example, the single sheet threshold is set at 0.625 of the monitored output signal.

The method has particular application in the counting of sheets and in the simplest example increments the count by one on each occasion that the single sheet threshold is passed. The method can be used to cause the sheet feeding apparatus to feed specific batch quantities of sheets so that when a certain count has been reached the sheet feeding apparatus is stopped or it can be used simply to count the total number of sheets in a stack of sheets.

After all the sheets in a stack have been fed through the sheet feeding apparatus, the method may further comprise erasing the or all the generated thresholds (but not the preset first threshold). In this way, the method can be repeated using the preset first threshold on a further batch of sheets having a different characteristic value.

Preferably, the method further comprises generating a double sheet threshold from the monitored size, the level of the output signal from the sensing assembly passing the double sheet threshold during the passage of two or more overlapped sheets. This enables overlapped sheets to be detected and if such overlapped sheets are unacceptable an error signal may be generated to, for example, halt the sheet feeding apparatus.

In a more sophisticated arrangement, the method further comprises generating a triple sheet threshold from the monitored size, the output signal level from the sensing assembly passing the triple sheet threshold during the passage of three or more overlapped sheets. This has particular advantages if used in conjunction with the generation of a double sheet threshold. Thus, if the double sheet threshold is passed but not the triple sheet threshold then in some circumstances this may be allowable with the assumption that two sheets have been fed. If a count is being incremented then this count would be incremented by two. If, however, the triple sheet threshold is passed then preferably an error signal is generated.

In this context, by "overlap" we include partial overlapping of sheets as well as full overlapping. In either event, at some stage during the passage of the overlapped sheets, at least the double sheet threshold will be passed.

Preferably, the output signal of the or each sensing assembly varies in accordance with the thickness of the sheets. Alternatively, the length of the sheets could be monitored or some other characteristic such as opacity. In a particularly convenient arrangement, both the thickness and length of the sheets is monitored.

In this specification, by "length" we means the dimension of a sheet in the direction of travel.

For example, when the sheets are moved at a substantially constant speed past the or each sensing assembly, the step of monitoring the length may comprise monitoring the time for which the single sheet threshold is passed. Alternatively, the length may be determined by monitoring the number of points about the guide surface periphery when the single sheet threshold is passed, thereby making the length measurement independant of speed.

Where length is monitored, the method may comprise generating an error signal if the monitored length of a sheet varies significantly from the monitored length of the first sheet fed past the sensing assembly.

Conveniently, two sensing assemblies are provided laterally spaced across a feed path of the sheets, the method comprising monitoring the output signals from each sensing assembly to detect the passage of incorrectly fed sheets. The use of two sensing assemblies enables the passage of skew fed sheets, folded sheets and the like to be sensed.

The or each sensing assembly may be provided by any conventional sensing system which provides an output signal varying in accordance with some characteristic of the sheets being fed. Preferably, however, the or each sensing assembly is provided by a pair of guide surfaces defining a nip through which the sheets pass; and means for sensing the deflection of one guide surface relatively to the other. This enables the thickness of the sheets passing the sensing assembly to be monitored.

An example of a particularly suitable sensing assembly is described in our copending U.S. Patent Application Ser. No. 625,786. In this arrangement, a guide surface profile is generated and stored when no sheet is fed through the nip between the guide surfaces. This guide surface profile corresponds to the datum level of the present invention.

The method and apparatus have particular application to banknote feeding apparatus such as banknote counting and sorting apparatus.

BRIEF DESCRIPTION OF THE DRAWINGS

An example of banknote counting apparatus for carrying out a method in accordance with the invention will now be described with reference to the accompanying drawings; in which.

DETAILED DESCRIPTION OF THE PREFERRED EMBODIMENTS

Figure 1:
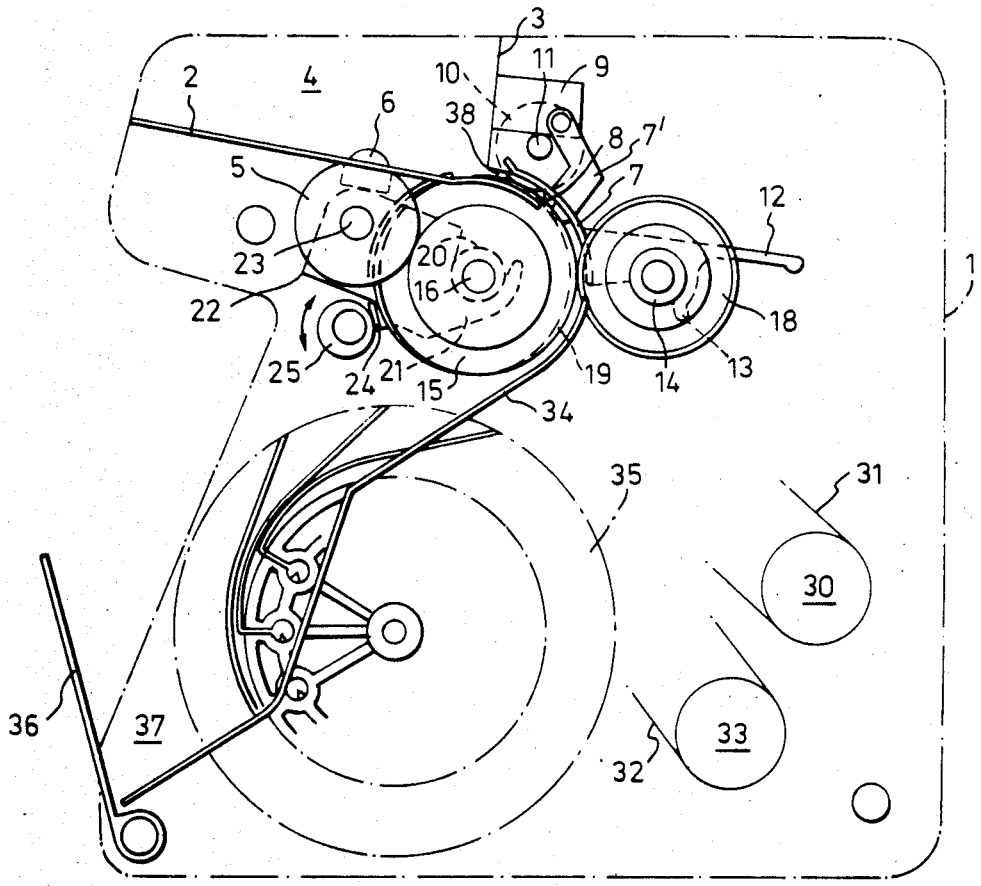
FIG. 1 is a diagrammatic side view of the apparatus.
Figure 2:
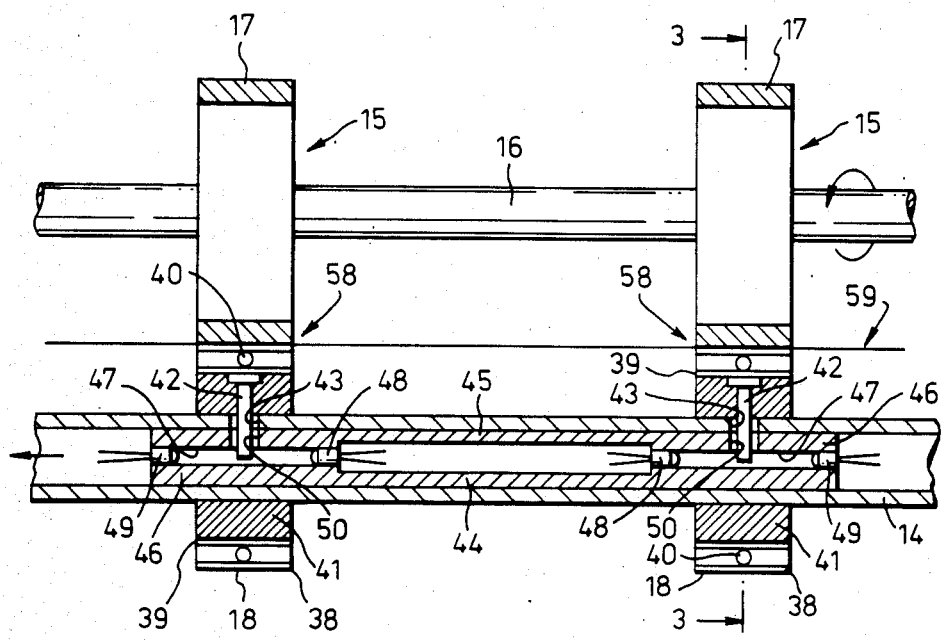
FIG. 2 is a partial cross-section through part of the sheet sensing apparatus with parts omitted for clarity.
Figure 3:
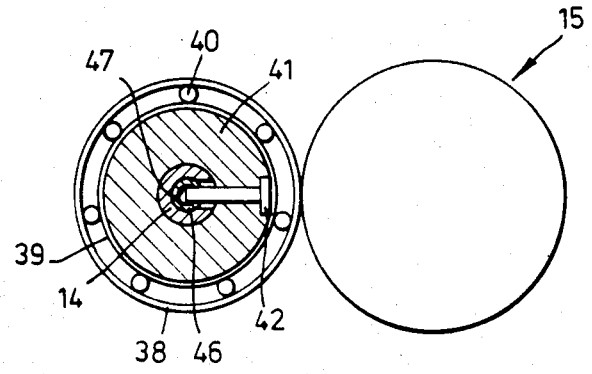
FIG. 3 is a section taken on the line 3—3 in FIG. 2.

The apparatus illustrated in the drawings is a banknote counting apparatus.

The apparatus comprises a metal housing 1 supporting a base plate 2 and an end plate 3 of an input hopper 4. Two conventional picker wheels 5 are rotatably mounted to the housing 1 and have radially outwardly projecting bosses 6 which, as the picker wheels rotate, periodically protrude through slots in the base plate 2.

A guide plate 7 having a curved guide surface 8 is pivotally mounted by an arm 7' to a lug 9 attached to the end plate 3. Two separation rollers 10 (only one shown in the drawings) are rotatably mounted to a shaft 11. A cantilevered arm 12 is connected to the guide plate 7 and includes a spring clip 13. When the guide plate 7 is in its first position shown, the spring clip 13 is located around a stationary shaft 14. If it is desired to cause the plate 7 to pivot away from its first position, the clip 13 is simply unclipped from the shaft 14 and pivoted in an anti-clockwise direction (as seen in FIG. 1) allowing the operator access to the note feed path so that a note jam can be cleared.

A pair of drive rolls 15 are non-rotatably mounted to a drive shaft 16 which is rotatably mounted to the housing 1. Each drive roll 15 has an outer annular portion 17 of rubber. Each drive roll 15 contacts a respective auxiliary roll 18 rotatably mounted on the shaft 14.

A pair of strippers roller 19 are rotatably mounted on a shaft 20 having a larger diameter than the shaft 16 about which it is positioned. The shaft 20 is secured between a pair of arms 21 of a cradle 22. The cradle 22 is rotatably mounted to an auxiliary drive shaft 23 on which the picker wheels 5 are mounted. The cradle 22 has a cam portion 24 which engages a cam 25 rotatably mounted to the housing 1. Manual rotation of the cam 25 forces the stripper rollers 19 towards the separation rollers 10 to define gaps of controlled width.

A drive motor 30 (shown schematically in FIG. 1) continuously drives the drive shaft 16 via a drive belt 31. The connection between the drive belt 31 and the drive shaft 16 has been omitted for clarity. The auxiliary drive shaft 23 is driven via a drive belt 32 by a drive motor 33 and is connected by a drive belt (not shown) to the stripper roller 19.

A guide plate 34 extends from adjacent the nips formed between the drive rolls 15 and auxiliary rolls 18 to a conventional stacker wheel 35 rotatably mounted on the housing 1. The guide plate 34 together with an end plate 36 define an output hopper 37.

The drive rolls 15 and auxiliary rolls 18 define sheet sensing apparatus for detecting the passage of two or more notes simultaneously and for counting banknotes. The drive rollers and auxiliary rolls are spaced apart by a distance less than the width of sheets being counted.

The apparatus shown in FIG. 1 is described in more detail and claimed in our copending European Patent Application No. 0132329.

The shaft 14 is hollow, and is non-rotatably supported by the housing 1, and carries the two auxiliary rolls or roller assemblies 18. These are identical in construction and each contacts a respective one of the drive rolls 15.

Each roller assembly 18 comprises a roller bearing having an annular outer race 38, an annular inner race 39 and bearings 40 positioned between the inner and outer races. The bearing is mounted coaxially about the shaft 14 on an annular rubber portion 41. A metal pin 42 abuts the radially inner surface of the inner race 39 and extends through the rubber portion 41 and an aperture 43 in the shaft 14 into the shaft.

A moulded plastics housing 44 is mounted within the shaft 14 and comprises a central tubular portion 45 integral with end portions 46 each of which has a bore 47 communicating with the tubular portion 45. A pair of light emitting diodes 48 are mounted in the inner ends of the bores 47 while a pair of phototransistors 49 are mounted at the outer ends of the bores 47. For clarity, only portions of the connecting wires from the light emitting diodes 48 and the phototransistors 49 have been illustrated. In fact, these wires will pass along and out of the shaft 14 to monitoring circuitry to be described below and to facilitate assembly, all wires extend from the same end of the shaft. Each portion 46 of the housing 44 also has an aperture 50 communicating with the bore 47 and in alignment with the aperture 32. The pins 42 extend through the apertures 50 into the bores 47.

Figure 4:
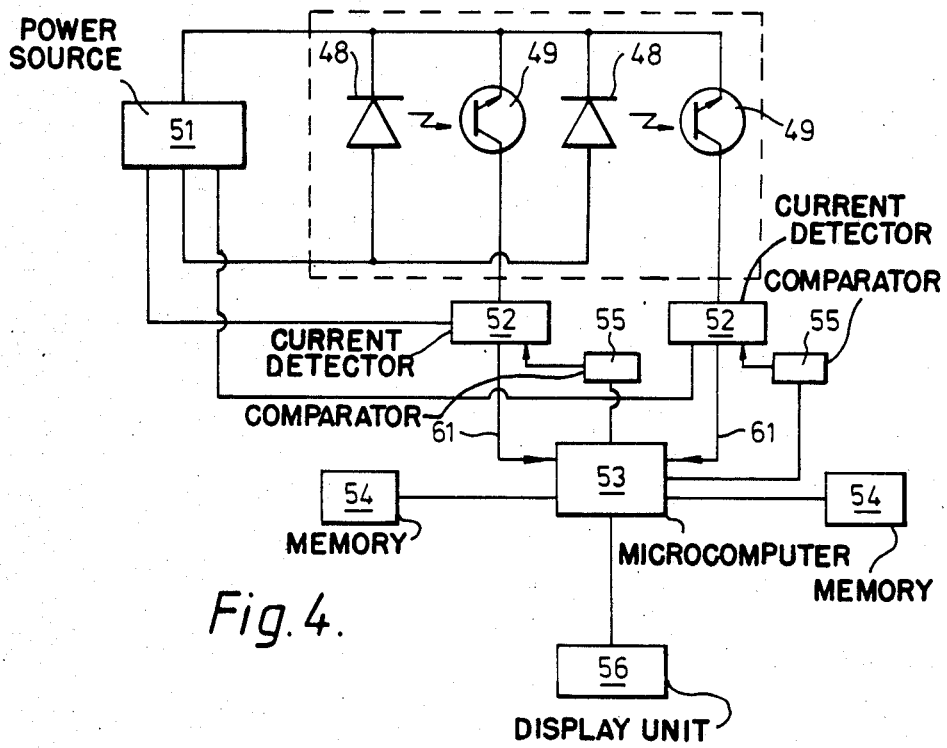
FIG. 4 is a block circuit diagram illustrating circuitry for connection to the sheet sensing apparatus of FIG. 2; and, FIG. 5 illustrates graphically typical output signals from the sensing assembly.

The circuitry is illustrated in more detail in FIG. 4. FIG. 4 illustrates the two light emitting diodes 48 and the phototransistors 49 each of which is connected to a power source 51. The section of the circuit shown enclosed in dashed lines is that section mounted in the plastics housing 44. The output from each phototransistor 49 is fed via respective voltage comparators 52 back to the power source 51. The output from the comparators 52 is fed to a microcomputer 53. The microcomputer 53 is also connected to a conventional counter and error display unit 56.

Figure 5:
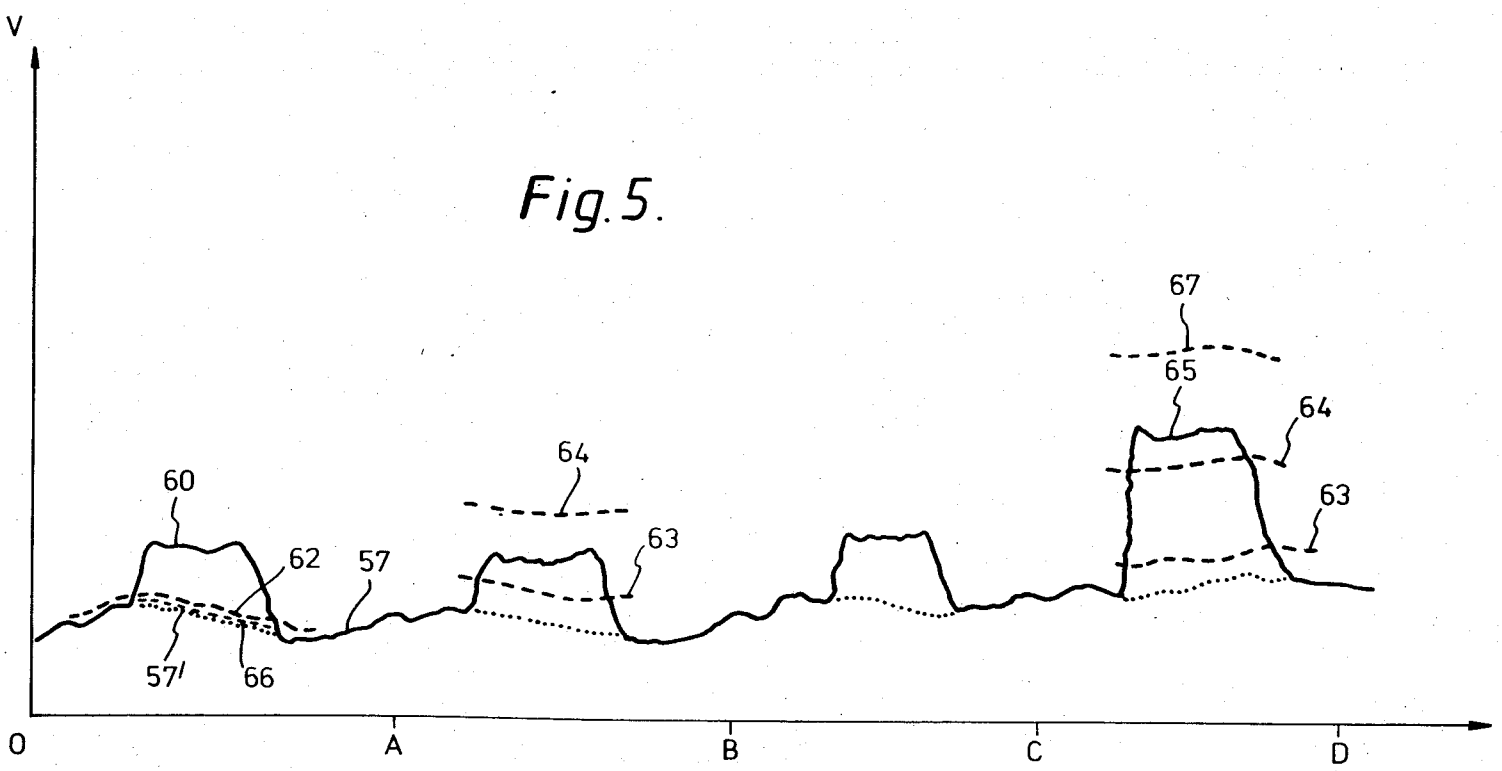

Initially, the drive rolls 15 are rotated and with no sheet present between the drive rolls 15 and roller assemblies 18, any deflection of each roller assembly 18 accompanied by compression of respective resilient portions 41 adjacent the drive rolls 15 will be sensed in a manner to be described at forty equally spaced intervals through one revolution of the roller assemblies 18. Compression of each rubber portion 41 in a radially inward direction will be accompanied by radially inward movement of each pin 42. Each LED 48 continuously emits light which impinges on respective phototransistors 49 causing them normally to be partially switched on. If a pin 42 moves radially inwardly, the pin 42 will increasingly obscure the path of optical rays from the LED's to the phototransistors 49 thus increasing the amount by which the phototransistors 49 are cut off. The output from the phototransistors 49 (illustrated in FIG. 5) is fed to the voltage comparators 52. Using a successive approximation technique the microcomputer 53 causes the comparators 52 to compare these outputs at forty equally spaced sampling positions around the drive rolls 15 (which will be determined by monitoring a timing disc (not shown) mounted non-rotatably to the shaft 16) with voltage values supplied to the comparators 52 via D/A converters 55. This produces forty sampled voltage values which are then stored in the respective memories 54 as a guide surface profile or datum level. A typical profile is illustrated by a line 57 in FIG. 5. The forty sampling positions occur between the origin of the graph in FIG. 5 and the position marked A and the guide surface profile comprises that portion of the line 57 up to the position A and including the dotted portion 57'. FIG. 5 illustrates the voltage input to the comparators 52 over a number of revolutions of the roller assemblies 18 and it will be seen that the guide profile comprising the line 57 and the dotted portions 57' is generally the same in each portion OA, AB, BC and CD.

A first voltage threshold 62 is set up defined by a constant differential just above the profile 57. This differential is just greater than the expected variation in phototransistor output voltage due to electrical noise but less than the change in output voltage due to the passage of the thinnest expected banknote. The first threshold, in the form of a differential over the datum level 57, may be set up during manufacture of the apparatus or subsequently by a user.

In use, a stack of banknotes of the same size (ie. thickness and length) is placed in the input hopper 4. The drive motors 30,33 are actuated so that both the drive shaft 16 and the auxiliary drive shaft 23 rotate. Rotation of the picker wheels 5 causes banknotes at the bottom of the stack to be urged towards a nip 38 between the stripper rollers 19 and the separation rollers 10. As the stripper rollers 19 rotate in response to the rotation of the auxiliary drive shaft 23, they will engage the adjacent note and carry this note past the guide surface 8 and into the nip 58 formed between the auxiliary rolls 18 and drive rolls 15. The width of the gaps between the stripper rollers 19 and separation rollers 10 will prevent more than one note being fed by the stripper rollers 19. The note will be fed between the drive rolls 15 and the auxiliary rolls 18 due to the continuous rotation of the shaft 16, the note being fed along the guide plate 34 into the stacker wheel 35 which is being rotated by the drive motor 30 and which will stack the note fed in the output hopper 37.

Each LED 48 continuously emits light which impinges on respective phototransistors 49 causing each phototransistor to pass collector current at an initial level. Each pin 42 normally partially obscures the light path. When a sheet 59 is presented to the nip 58 between the drive rolls 15 and the respective roller assemblies 18, the sheet will be taken up and transported through the nip and each rubber portion 41 will be compressed radially inwardly due to pressure exerted from the outer race 38 via the bearings 40 and the inner race 39. This movement will also be accompanied by a radially inward movement of each pin 42, which will thus further obscure the path of optical rays from the LED's 48 to the phototransistors 49 thus further attenuating light transmitted to the transistors 49.

Repeatedly, at each of the forty sampling positions, the microcomputer 53 adds the preset differential to the respective voltages stored in the memory 54 to define the first threshold 62 and supplies these to the comparators 52. An example of a set of output signals caused by the presence of a single note in the nip 58 is illustrated by a line 60 in FIG. 5. It will be seen that part of the line 60 is the same as the line 57 but that over a portion of the sampling region OA it is substantially different. The comparators 52 compare successively the forty values with the corresponding forty values from the microcomputer 53 and generate an output on a line 61 (FIG. 4) related to whether or not the thresholds 62 are exceeded. As is to be expected from a banknote with a substantially constant thickness the difference between the signals represented by the line 60 and the corresponding portion 57' of the stored profile is substantially uniform.

When the threshold 62 has been exceeded at a number of the sampling positions (normally less than forty since the length of the banknote is generally shorter than the drive wheel circumference) it is assumed that a banknote has passed through the nip. If the presence of a banknote is detected by both phototransistors 49 then the microcomputer 53 causes the unit 56 to increment the count by 1. In addition, in response to the feeding of the first note, a single sheet threshold 63 is calculated by the microcomputer 53 representing the difference between the comparator input and the stored datum profile corresponding to a note having marginally greater than half the thickness of the note detected. For example 0.625 times the thickness of the note detected. Other fractions could also be used.

The microcomputer 53 also calculates a double sheet threshold 64 corresponding to 1½ sheet thicknesses and a triple sheet threshold 67 corresponding to 2½ sheet thicknesses but other multiples could be used.

For the remaining banknotes in the hopper 4, the voltage signals input to the comparators 52 are compared at each of the forty sampling positions with each of the the new thresholds to determine which of the thresholds are exceeded. This will be described in more detail later.

With typical materials, it is unlikely that two successive full rotations of the drive rolls 15 and auxiliary rolls 18 will cause the phototransistors 49 to provide exactly similar outputs due to dirt coming off the notes. Thus, for example, even when no note is present in the nip 58, a subsequent voltage input to the comparators 52 might have the form shown by a line 66 in FIG. 5. It should be noted that this change will be less than the differential defined by the difference between the first threshold 62 and datum 57 and so the microcomputer 53 would determine that the threshold 62 was not exceeded and thus the passage of a note had not occurred.

Additionally, over a period of time, the output from the phototransistors 49 may change significantly, that is by an amount similar to that which would be expected from the passage of a note. In order that the apparatus can still function, the microcomputer 53 causes a new profile to be stored by the memories 54 instead of the previously stored profile 57, 57' just before a new stack of banknotes are counted. Since the first threshold 62 is defined in terms of a differential it will be adjusted automatically.

In some cases, a folded note may be passed through the apparatus in which case one of the comparators 52 may indicate the presence of a note 59 while the signals passed to the other comparator 52 will suggest that no note is present. The microcomputer 53 can detect from the signals passed to it along the lines 61 that they represent different differences and in such a case can cause the unit 56 to display an appropriate error message.

The microcomputer 53 can also be programmed to be able to detect half notes as well as folded notes, and notes which have been fed in a skewed manner. In addition, one important feature is that the length of notes fed can be determined. Where the output from the phototransistors 49 is monitored at eight or more positions a progressively more accurate determination of the length of a note being fed can be achieved. This is particularly useful since it provides a non-time dependent method of measuring note length.

After a stack of notes has been fed, the microcomputer 53 may erase the differentials stored representing the thresholds 63, 64, 65 but the differential representing threshold 62 will remain permanently stored. The apparatus is then ready to process a new stack of banknotes.

As has just been mentioned, when determining the thickness at a number of points on the first reference note fed, the "length" in the direction of travel can also be determined. This information is then utilised in conjunction with the thickness data to assist in counting subsequent notes and determining if overlapped, short or long notes are being fed.

In particular, the following information may be deduced by the microcomputer 53;

(a) If the measured "length" of double thickness notes combined with lengths of single thickness notes equate to two notes partially overlapped then two notes may be counted. If they do not then an error condition is deduced.

(b) If a double thickness is sensed by one sensor and only a single thickness by the other and the lengths are correct, this may represent a note with tape on one side. The effects of the tape may be ignored. Similarly if only part of a correct length note is sensed as double thickness then the "double thickness" output signal may be ignored.

(c) If a thickness greater than 2½ times the note thickness is sensed ie. the output signal exceeds the triple sheet threshold 67 over part of the sensing zone, then an error condition is indicated as a three note thickness has been detected. For example, a note folded in half may be fed with a single note sandwiched between the two folded halves.

In some cases, the first note may not be a single "correct" note and therefore false values for note lengths and thickness, and hence the calculated threshold, may be determined. The processing of subsequent notes will indicate whether or not this is the case.

The following are simplified examples in which a thickness of a single note is denoted by "T" and its length in the direction of feed by "L".

EXAMPLE 1

The first "note" fed is a double thickness note, for example two overlapped notes, with a thickness 2T. In this case, a single sheet threshold will be set to a value a little greater than T and the length measurement to L since the notes are fully overlapped. When the next note is sensed, the single sheet threshold 63 will not be achieved but the presence of a sheet will be detected since the first threshold 62 will be exceeded. The microcomputer 53 will deduce from this that a note less than the single sheet threshold has been sensed and an error has occurred. In this situation, the microcomputer 53 will cause an error signal to be generated which causes a suitable message to be displayed by the unit 56 and can additionally cause the drive motors 30, 33 to stop.

EXAMPLE 2

In this example, the first "note" fed comprises two partially overlapped notes. Due to the averaging of the thicknesses, the single sheet threshold may not be greater than the thickness T of the next note fed and therefore the condition in Example 1 above will not cause an error condition. In this case, however, the length of the next note will be less than the length determined from the first overlapped notes due to the reduced length of the following note and again an error condition is indicated.

EXAMPLE 3

In this example, once again it is assumed that the first "note" comprises two partially overlapped notes. In Example 2 it was assumed that the measured lengths at both sensors was substantially the same. However, due to the nature of banknotes, one or both notes may be skewed and therefore the lengths measured may be different at each sensor. Preferably, therefore, the microcomputer 53 compares any difference between measured lengths with a threshold and if this difference is too great causes an error signal to be generated.

EXAMPLE 4

In some cases, a maximum length threshold may be preset so that if either sensor determines a length which is outside this threshold, an error signal is generated.

EXAMPLE 5

If a note is only sensed by one sensor then an error condition is indicated which may identify the fed note as a half note for example.

It will be seen by consideration of the examples above that it is ensured that the thresholds set up as a result of the first fed note are representative of subsequent notes. The checks may also be carried out on at least some of the following notes in case the notes subsequent to the first notes are also double or overlapped.

We claim:

1. A method of monitoring the passage of sheets past at least one sheet sensing assembly of a sheet feeding apparatus, said at least one sensing assembly generating an output signal whose level varies in accordance with a characteristic of said sheets, the method comprising, for said at least one sensing assembly, setting a single sheet output signal threshold at a level which will be passed by said output signal generated by said sensing assembly when a sheet passes said sensing assembly;

monitoring said output signal at least when it passes said threshold;

presetting a first threshold spaced by a predetermined amount from a datum output signal level achieved when no sheet is sensed, said predetermined amount being such that said first threshold is not passed as a result of random noise variations in said output signal but is passed during the passage past said sensing assembly of all sheets which it is desired to monitor;

monitoring the size of said output signal relative to said datum level when said output signal first passes said first threshold corresponding to the passage of a first sheet;

generating said single sheet threshold from said monitored size; and thereafter sensing when said output signal passes said thresholds.

2. A method according to claim 1, further comprising generating an error signal if said output signal passes said first threshold but not said single sheet threshold.

3. A method according to claim 1, further comprising generating a double sheet threshold from said monitored size, the level of said output signal from said sensing assembly passing said double sheet threshold during the passage of at least two overlapped sheets.

4. A method according to claim 1, further comprising generating a triple sheet threshold from said monitored size, said output signal level from said sensing assembly passing said triple sheet threshold during the passage of at least three overlapped sheets.

5. A method according to claim 4, further comprising generating an error signal if said output signal level passes said triple sheet threshold.

6. A method according to claim 3, further comprising generating a triple sheet threshold from said monitored size, said output signal level from said sensing assembly passing said triple sheet threshold during the passage of at least three overlapped sheets and detecting the passage of two overlapped sheets when said output signal level from said sensing assembly passes said double sheet threshold but not said triple sheet threshold.

7. A method according to claim 1, wherein said output signal of said sensing assembly varies in accordance with the thickness of said sheets.

8. A method according to claim 1, further comprising monitoring the length of said sheets passing said at least one sensing assembly.

9. A method according to claim 8, wherein said sheets are moved at a substantially constant speed past said at least one sensing assembly, said step of monitoring said length comprising monitoring the time for which said single sheet threshold is passed.

10. A method according to claim 8, further comprising generating an error signal if said monitored length of a sheet varies significantly from said monitored length of a first sheet fed past said sensing assembly.

11. A method according to claim 1, wherein said sheets are fed along a feed path, and in which two sensing assemblies are provided laterally spaced across said feed path of said sheets, the method comprising monitoring the output signals from each sensing assembly to detect the passage of incorrectly fed sheets when said output signals differ.

12. Apparatus for monitoring the passage of sheets past at least one sensing assembly, said sensing assembly being adapted to generate an output signal whose level varies in accordance with a characteristic of said sheets, the apparatus comprising storage means for storing for said at least one sensing assembly a single sheet output signal threshold corresponding to a signal level which will be passed by said output signal generated by said sensing assembly when a sheet passes said sensing assembly; monitoring means for monitoring said output signal; means for storing a first, preset threshold spaced by a predetermined amount from a datum output signal level achieved when no sheet is sensed, said predetermined amount being such that said first threshold is not passed as a result of random noise variations in said output signal but is passed during the passage past said sensing assembly of all sheets which it is desired to monitor, said monitoring means being adapted to monitor said size of said output signal relative to said datum level when it first passes said first threshold; and calculating means for calculating said single sheet threshold from said monitored size and for storing said single sheet threshold in said storage means.

* * * * *